US010828890B2

(12) United States Patent
Kuronuma et al.

(10) Patent No.: US 10,828,890 B2
(45) Date of Patent: Nov. 10, 2020

(54) PRINTING APPARATUS AND PRINTHEAD ADJUSTMENT METHOD

(71) Applicant: CANON KABUSHIKI KAISHA, Tokyo (JP)

(72) Inventors: Daigo Kuronuma, Kawasaki (JP); Masakazu Nagashima, Yokohama (JP); Ryohei Maruyama, Kawasaki (JP); Tomohito Abe, Yokohama (JP); Noriyuki Aoki, Tokyo (JP); Naoaki Wada, Yokohama (JP); Toshiaki Yamaguchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/255,238

(22) Filed: Jan. 23, 2019

(65) Prior Publication Data

US 2019/0232641 A1 Aug. 1, 2019

(30) Foreign Application Priority Data

Jan. 30, 2018 (JP) ..... 2018-014117

(51) Int. Cl.

| | |
|---|---|
| ***B41J 2/045*** | (2006.01) |
| ***B41J 19/14*** | (2006.01) |
| ***B41J 25/00*** | (2006.01) |
| ***B41J 2/21*** | (2006.01) |

(52) U.S. Cl.
CPC ..... *B41J 2/04505* (2013.01); *B41J 2/04586* (2013.01); *B41J 2/2132* (2013.01); *B41J 19/142* (2013.01); *B41J 25/003* (2013.01)

(58) Field of Classification Search
CPC combination set(s) only.
See application file for complete search history.

(56) References Cited

U.S. PATENT DOCUMENTS

2015/0091958 A1* 4/2015 Terada ..... B41J 2/13 347/9

FOREIGN PATENT DOCUMENTS

JP 2013-230693 A 11/2013

* cited by examiner

*Primary Examiner* — Bradley W Thies
(74) *Attorney, Agent, or Firm* — Venable LLP

(57) ABSTRACT

In an embodiment of the present invention, even though there is a print shift due to a gap between a nozzle in an upstream side and a nozzle in a downstream side of a printhead, a printing apparatus capable of precisely adjusting a slant of a printhead with respect to a conveyance direction in a nozzle surface of the printhead is provided. According to the embodiment, two adjustment patterns are printed at two different carriage speeds, respectively, and a print shift due to a slant of the nozzle surface of the printhead with respect to a conveyance direction of a print medium is adjusted based on these two print results.

12 Claims, 11 Drawing Sheets

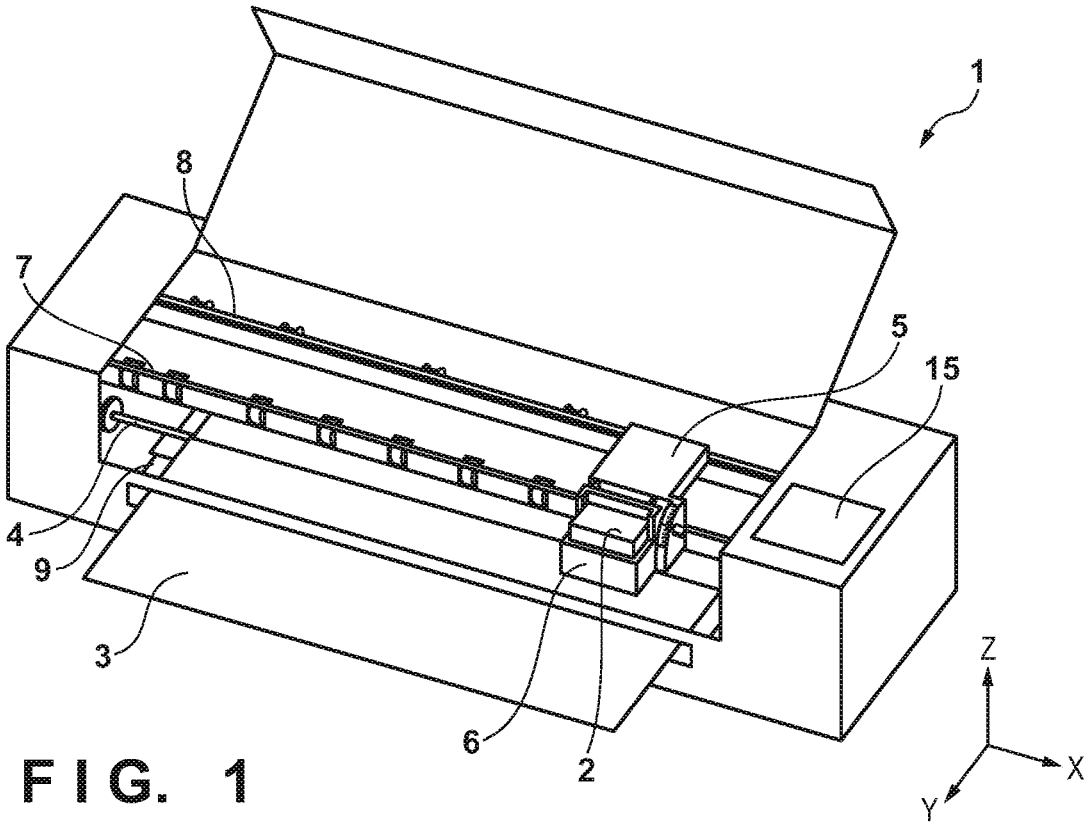
FIG. 1
FIG. 2
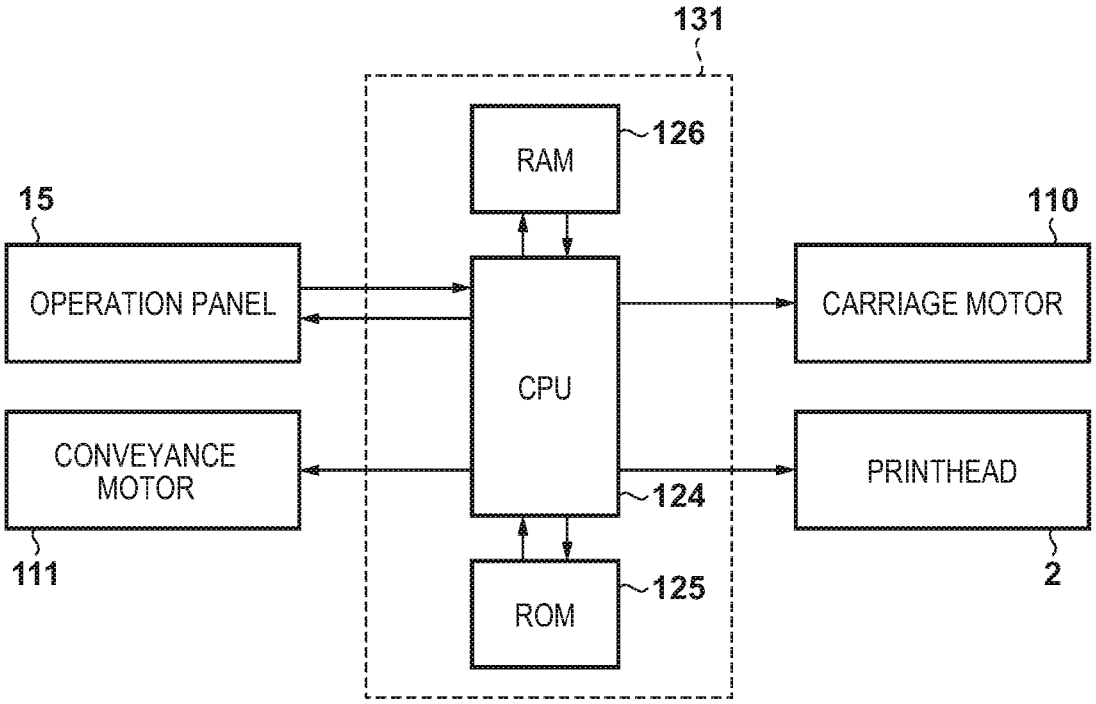

PRINTING APPARATUS AND PRINTHEAD ADJUSTMENT METHOD

BACKGROUND OF THE INVENTION

Field of the Invention

The present invention relates to a printing apparatus and a printhead adjustment method, and particularly to a printing apparatus that prints an image onto a print medium by an inkjet printhead and a method for adjusting the printhead, for example.

Description of the Related Art

In recent inkjet printing apparatuses, further increases in speed and improvements in image quality have been sought. In response to the demand for increases in speed, use of a printhead that has a longer print width can be considered, and in response to the demand for improvements in image quality, it has become necessary to incorporate techniques for adjusting a shift of a printing position. A printing position shift appears as a shift with respect to the direction (main scanning direction) in which the printhead moves due to an assembly error of a nozzle surface (nozzle formation surface through which ink is discharged) in the printhead and the like, for example. In detail, regarding a nozzle array in which a plurality of nozzles are arranged, printing by a nozzle group which is on an upstream side and printing by a nozzle group which is on a downstream side in the direction in which a print medium is conveyed (sub-scanning direction) will be shifted in the main scanning direction.

Specifically, there is a possibility that a shift (hereinafter, a ruled line shift) of the boundary of each print scanning area will become more noticeable for a serial type printing apparatus that performs high speed printing of a line drawing in which an image is composed of a plurality of ruled lines such as in a CAD application. In order to resolve this problem, there is proposed a method for printing a plurality of patterns onto a print medium, calculating an adjustment value from information obtained from these patterns, and shifting a timing for discharging ink droplets based on the adjustment value in order to better adjust a shift of a printing position than in the past (with reference to Japanese Patent Laid-Open No. 2013-230693).

A print position shift due to a slant with respect to a conveyance direction of the print medium on the nozzle surface of the printhead is not the only cause of a ruled line shift. Besides that, a print position shift due to a difference in the distance to the sheet (hereinafter, the upstream-downstream difference in the distance to the sheet) between the upstream nozzle group and the downstream nozzle group in the conveyance direction of the print medium for the distance (hereinafter distance to the sheet) between the print medium (or a platen) and the nozzle surface of the printhead may be the cause.

However, the conventional adjustment method proposed in Japanese Patent Laid-Open No. 2013-230693 only considered slant, and did not make adjustments considering the upstream-downstream difference in the distance to the sheet. There is the possibility that adjustment error will be large in an adjustment made without considering the upstream-downstream difference in the distance to the sheet, and the quality of a printed image may be degraded with a ruled line shift or the like.

SUMMARY OF THE INVENTION

Accordingly, the present invention is conceived as a response to the above-described disadvantages of the conventional art.

For example, a printing apparatus and a printhead adjustment method according to this invention are capable of reducing print position shift error.

According to one aspect of the present invention, there is provided a printing apparatus comprising: a printhead that has a nozzle array in which a plurality of nozzles configured to discharge ink are arrayed; a conveyance unit configured to convey a print medium in a first direction; a carriage on which the printhead is mounted such that a direction of the nozzle array is approximately the first direction and configured to reciprocally move in a second direction that intersects the first direction; a print unit configured to print a first pattern on a print medium when the carriage is moving at a first speed, and to print a second pattern on the print medium when the carriage is moving at a second speed different from the first speed in a direction that is the same as the movement at the first speed; an obtaining unit configured to obtain an adjustment value that is for adjusting a print shift in relation to the second direction and that is related to the first pattern and the second pattern printed by the print unit; an adjustment unit configured to adjust a slant of the printhead with respect to the first direction; and an instruction unit configured to instruct the adjustment value obtained by the obtaining unit to the adjustment unit.

According to another aspect of the present invention, there is provided a printhead adjustment method for adjusting a printhead in a printing apparatus comprising a printhead that has a nozzle array in which a plurality of nozzles for discharging ink are arrayed, a conveyance unit configured to convey a print medium in a first direction, and a carriage on which the printhead is mounted such that a direction of the nozzle array is approximately the first direction and that is configured to reciprocally move in a second direction that intersects the first direction, the method comprising: printing a first pattern on a print medium when the carriage is moving at a first speed; printing a second pattern on the print medium when the carriage is moving at a second speed different from the first speed in a direction that is the same as the movement at the first speed; obtaining an adjustment value for adjusting a print shift in relation to the second direction related to the printed first pattern and second pattern; and adjusting a slant of the printhead with respect to the first direction using the calculated adjustment value.

The invention is particularly advantageous since it can reduce print position shift error and print an image at high quality.

Further features of the present invention will become apparent from the following description of exemplary embodiments (with reference to the attached drawings).

BRIEF DESCRIPTION OF THE DRAWINGS

FIG. 1 is a perspective view which illustrates schematically a main configuration of an inkjet printing apparatus according to an exemplary embodiment of the present invention;

FIG. 2 is a block diagram which illustrates an overview of a control configuration of the inkjet printing apparatus which is illustrated in FIG. 1;

DESCRIPTION OF THE EMBODIMENTS

Figure 3:
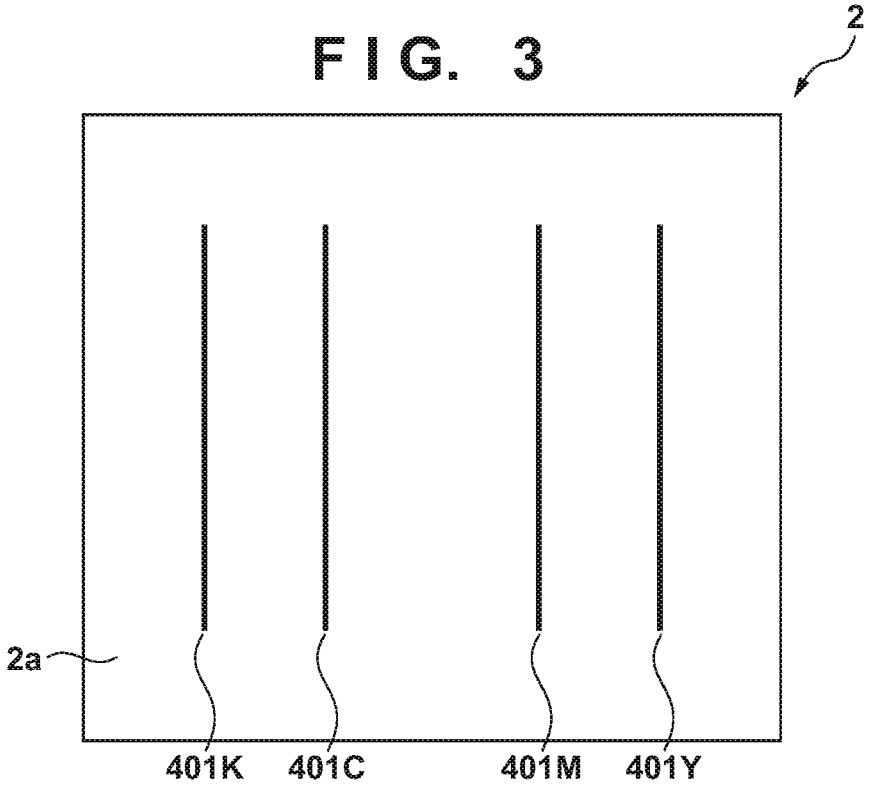
FIG. 3 is a view which illustrates a nozzle surface in which nozzles which discharge ink of a printhead are formed.

Exemplary embodiments of the present invention will now be described in detail in accordance with the accompanying drawings. Note that portions that have already been described will be given the same reference numerals and redundant description will be omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

<Overview of Printing Apparatus (FIG. 1 to FIG. 3)>

FIG. 1 is a perspective view schematically illustrating a main configuration of an inkjet printing apparatus 1 (hereinafter, printing apparatus) which is an exemplary embodiment of the present invention.

In FIG. 1, a printhead 2 is detachably mounted in a head holder 6 that reciprocally moves in the X arrow direction (main scanning direction) together with a carriage 5. The carriage 5 is slidably supported by a main guide rail 7 and a sub-guide rail 8 and reciprocally moves along these two guide rails by a driving force caused by the driving of a carriage motor (not shown).

A conveyance operation for conveying a print medium 3 by a conveyance roller 4 in a direction (sub-scanning direction) indicated by the Y arrow direction which intersects the main scanning direction for every predetermined pitch and a movement operation which causes the printhead 2 to reciprocally move while discharging ink from nozzles of the printhead 2 based on print data are performed. Ink droplets land on the print medium 3 and images which include text, numerals, or the like are printed by repeating such operations (hereinafter, a print pass operation).

Note, ink discharge from the printhead 2 is performed with respect to the print medium 3 which is on a platen 9.

Also, an operation panel 15 on which an LCD for displaying messages and keys used for performing instructions with respect to the printing apparatus 1 are arranged is equipped at one end in the X direction of the printing apparatus 1.

FIG. 2 is a block diagram illustrating an overview of a control configuration of the printing apparatus illustrated in FIG. 1.

In FIG. 2, operations of each unit of the printing apparatus 1 are controlled by a CPU 124 executing control programs stored in a ROM 125 provided on a control substrate 131 based on various data and the like stored in a RAM 126. In other words, the CPU 124 controls discharge of the printhead 2 and executes control of various motors such as a carriage motor 110 which causes the carriage 5 to be driven and a conveyance motor 111 which causes the conveyance roller 4 to be driven. Furthermore, the CPU 124 connects the operation panel 15 which is a user interface (UI) of the printing apparatus 1 and controls various operations and display for the printing apparatus 1 via the operation panel 15.

FIG. 3 is a view which illustrates a nozzle surface 2*a* in which nozzles which discharge ink of the printhead 2 are formed.

As illustrated in FIG. 3, a nozzle array of four nozzle arrays 401K, 401C, 401M, and 401Y is formed on a nozzle surface 2*a* for the printhead 2 to discharge different inks. 1280 nozzles (print elements) are arranged in each nozzle array at 1200 dpi intervals. In this embodiment, four colors of ink—black (K), cyan (C), magenta (M), and yellow (Y)—are discharged from the nozzle arrays 401K, 401C, 401M, and 401Y. In a case of the printhead 2 being mounted in the carriage 5, each nozzle array is oriented in the sub-scanning direction and ink droplets are discharged at a resolution of 1200 dpi in the sub-scanning direction from the 1280 nozzles.

Also, the printhead 2 is integrated with the ink cartridge in order to supply ink (black, cyan, magenta, and yellow ink) which is discharged from the printhead 2. Each of the plurality of nozzle arrays 401K, 401C, 401M, and 401Y is used for printing dots in a common area of the print medium 3.

<Configuration of a Peripheral Area of the Carriage 5 (FIG. 4 to FIG. 6C)>

Figure 4:
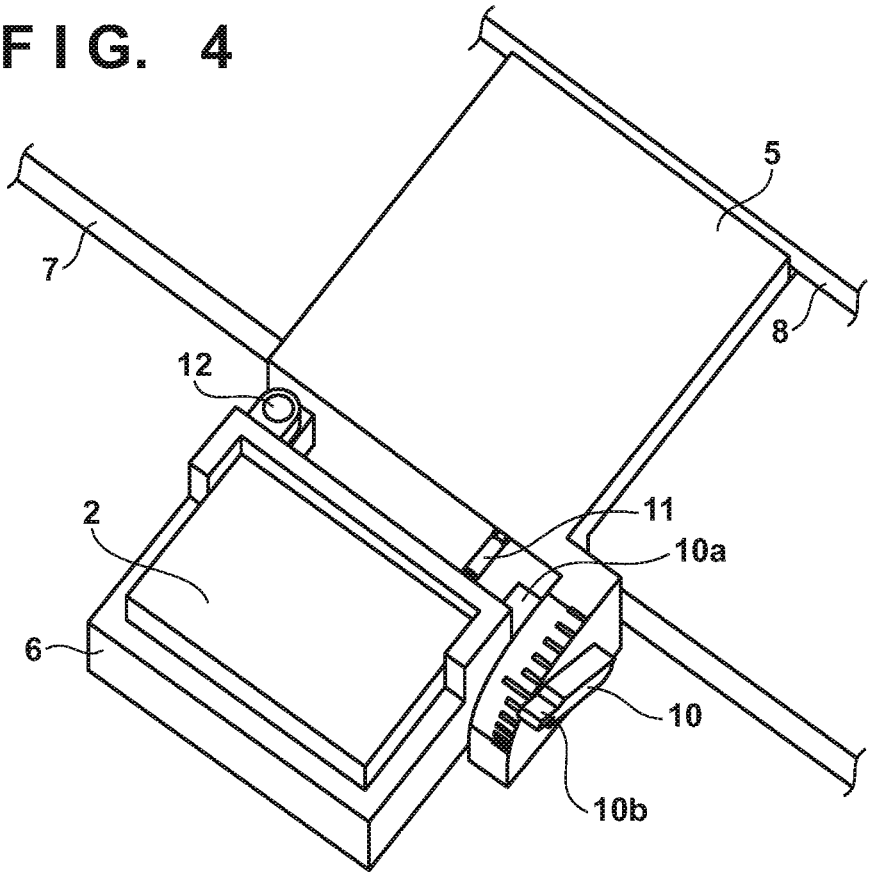
FIG. 4 is a perspective view which illustrates schematically a detailed configuration of a vicinity of a carriage of the inkjet printing apparatus which is illustrated in FIG. 1.
Figure 5:
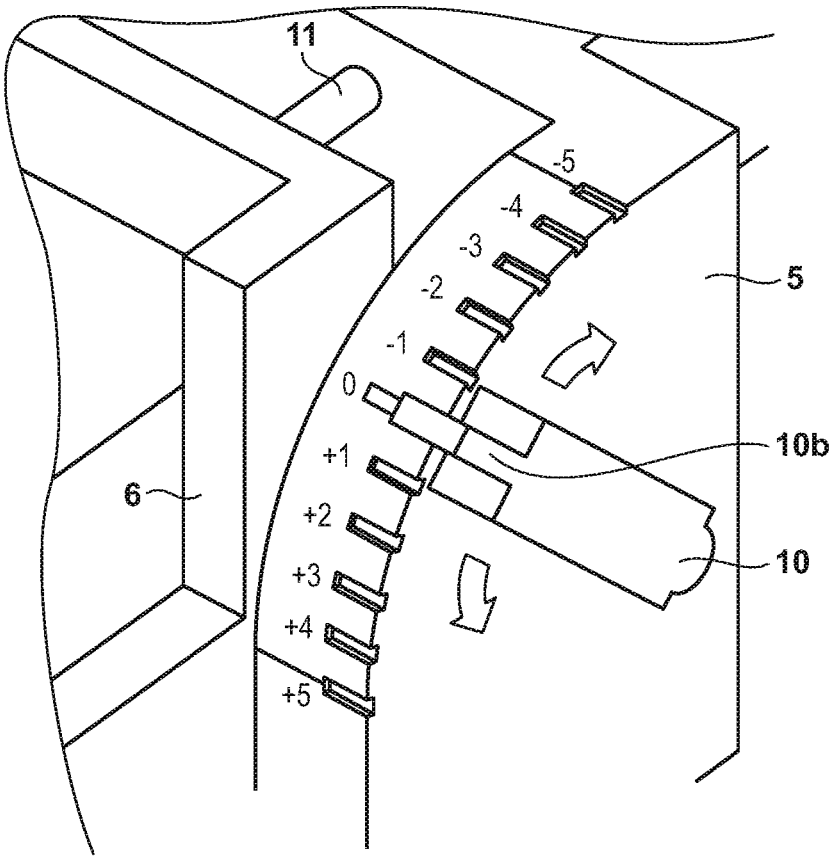
FIG. 5 is a perspective view which illustrates a detailed configuration of an adjustment lever which is arranged at a side surface of a carriage.
Figure 6A:
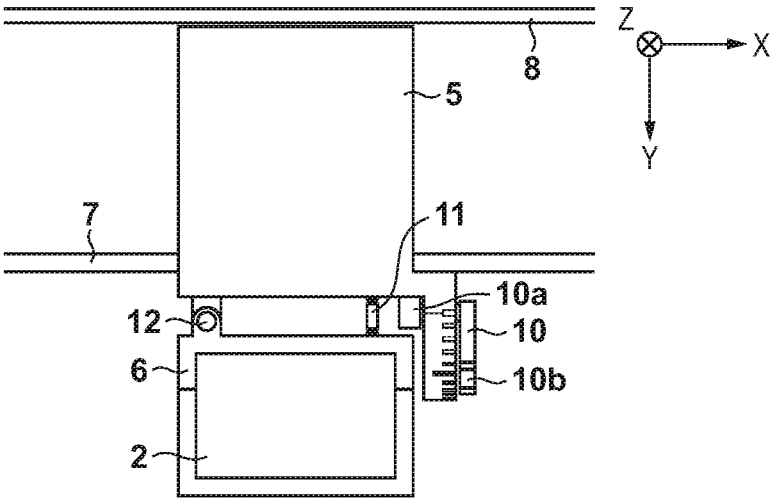
FIGS. 6A, 6B, and 6C are top views which illustrate a detailed configuration of a vicinity of the carriage.
Figure 6B:
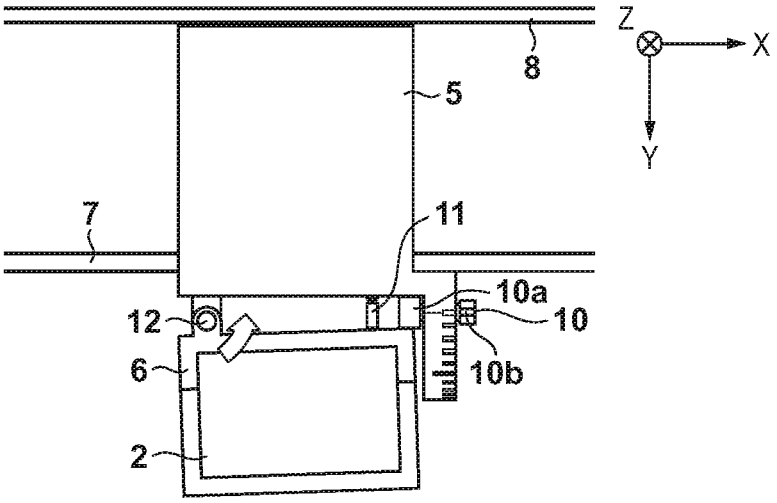
Figure 6C:
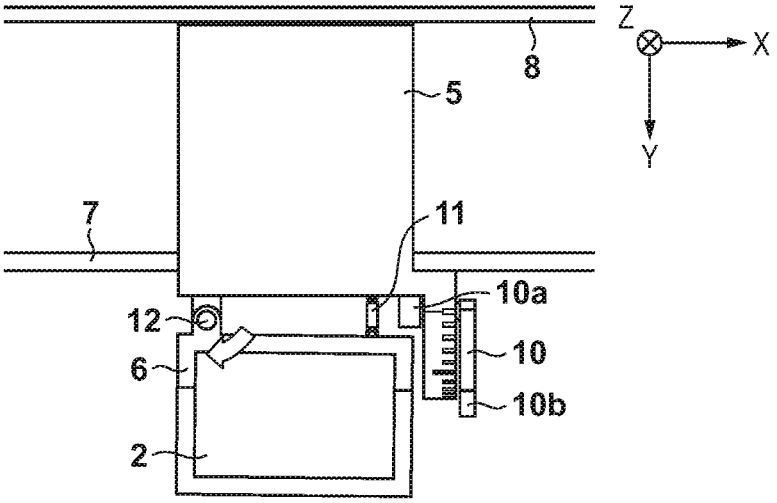

FIG. 4 is a perspective view illustrating a detailed configuration in a vicinity of the carriage 5 of the printing apparatus 1 illustrated in FIG. 1. FIG. 5 is a perspective view which illustrates a detailed configuration of an adjustment lever which is arranged at a side surface of the carriage 5. FIG. 6A to FIG. 6C are top views illustrating a detailed configuration of the periphery of the carriage 5.

The carriage 5 illustrated in FIG. 4 to FIG. 6C can rotate at a slight angle about the Z axis which is orthogonal to the X axis and Y axis illustrated in FIG. 1, and an adjustment lever 10 is arranged at the outer surface of the head holder 6 for adjusting a slant of the carriage 5. A user adjusts the slant of the carriage 5 by rotating the adjustment lever 10.

As illustrated in FIG. 4, a leading edge portion 10*a* of the adjustment lever 10 is cam shaped and contacts with the head holder 6. The head holder 6 is pressed to the cam portion of the adjustment lever 10 by a tension spring 11. For this reason, when the adjustment lever 10 is rotated, the cam portion causes the printhead 2 together with the entire head holder 6 to rotate about the Z axis illustrated in FIG. 1 centered on a fixed axis 12 which is fixed to the carriage 5.

As illustrated in FIG. 5, the adjustment lever 10 is adjustable by 5 graduations in each of the + direction (anticlockwise direction arrow) and the − direction (clockwise direction arrow) with the initial position set to "0". Also, the user rotates a knob 10*b* in the arrow directions and adjusts the position of the head holder 6 about the Z axis.

FIG. 6A illustrates a top view of the carriage when the graduation of the adjustment lever 10 is "0", FIG. 6B illustrates a top view of the carriage when the graduation of the adjustment lever 10 is "−5", and FIG. 6C illustrates a top view of the carriage when the graduation of the adjustment lever 10 is "+5".

The printhead 2 rotates anticlockwise (counterclockwise) centered on the fixed axis 12 when the adjustment lever 10 is rotated upward (− direction) as in FIG. 6A and FIG. 6B and rotates clockwise centered on the fixed axis 12 when the adjustment lever 10 is rotated downward (+ direction) as in FIG. 6A and FIG. 6C. By this, it is possible to adjust the tilt (slant) with respect to the sub-scanning direction of the nozzle array of the printhead 2.

<Print Shift in Slant (FIG. 7A to FIG. 9C)>

Next, description will be given for printing when the nozzle array in the nozzle surface of the printhead is slanted with respect to the conveyance direction of the print medium (sub-scanning direction), that is when there is a slant.

Figure 7A:
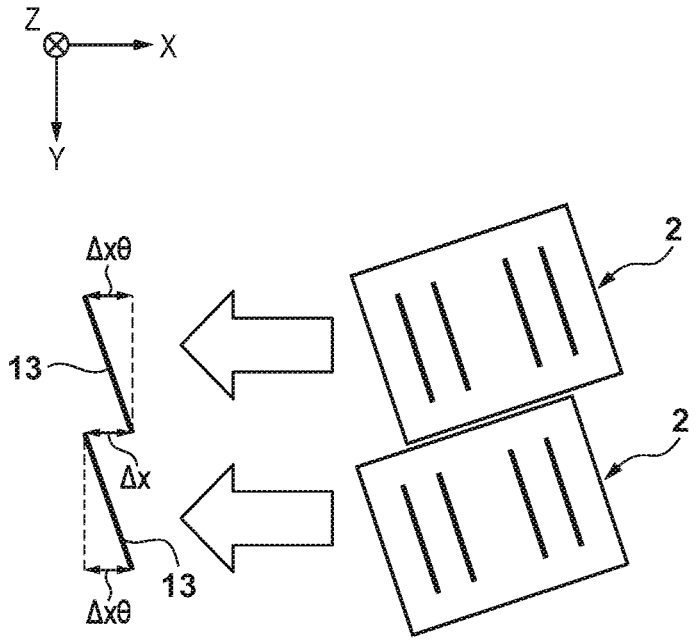
FIGS. 7A and 7B are views which illustrate a print shift caused by a slant.
Figure 7B:
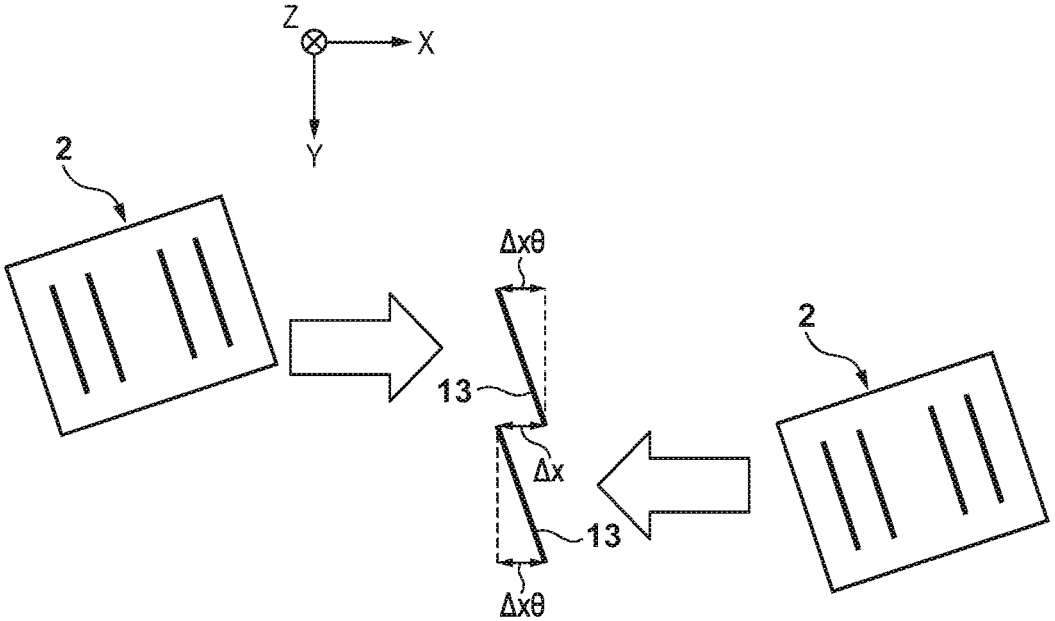

FIG. 7A and FIG. 7B are views that illustrate a print shift due to a slant. FIG. 7A represents a state when forward printing is performed by the printhead 2 and FIG. 7B when reciprocal printing is performed by the printhead 2.

A print shift (Δxθ) due to a slant illustrated in FIG. 7A and FIG. 7B is of the same size in printing (hereinafter, one-way printing) during forward movement or backward movement of the printhead 2. Accordingly, in the case of one-way printing and in the case of printing (hereinafter, two-way printing) in which both forward movement and backward movement are performed, a shift Δx of the ruled line 13 of the same size appears in the image as illustrated in FIG. 7A and FIG. 7B at a print pass operation joint. A print shift Δxθ due to the slant at that time is a shift of Δxθ in the main scanning direction between the most upstream nozzle and the most downstream nozzle in the sub-scanning direction for the printhead 2, and the print shift Δxθ due to this slant is simply the ruled line shift Δx.

Because the ruled line shift Δx is visually recognizable by humans at even, for example, 30 to 50 μm, it is necessary to adjust a slant of the printhead 2 occurring due to attachment of the printhead 2, part precision, or the like. To do so, the user can operate the adjustment lever 10 after attaching or replacing of the printhead 2. In this embodiment, it is possible to rotate the printhead 2 about the Z axis to correct by an amount of Δxθ=20 μm for one graduation of the adjustment lever 10. That is, in this embodiment, it is possible to correct up to Δxθ=±100 μm.

A print shift may also occur due to an upstream-downstream difference in the distance to the sheet in addition to the previously described slant. This will be described with reference to FIG. 8A to FIG. 9C.

Figure 8A:
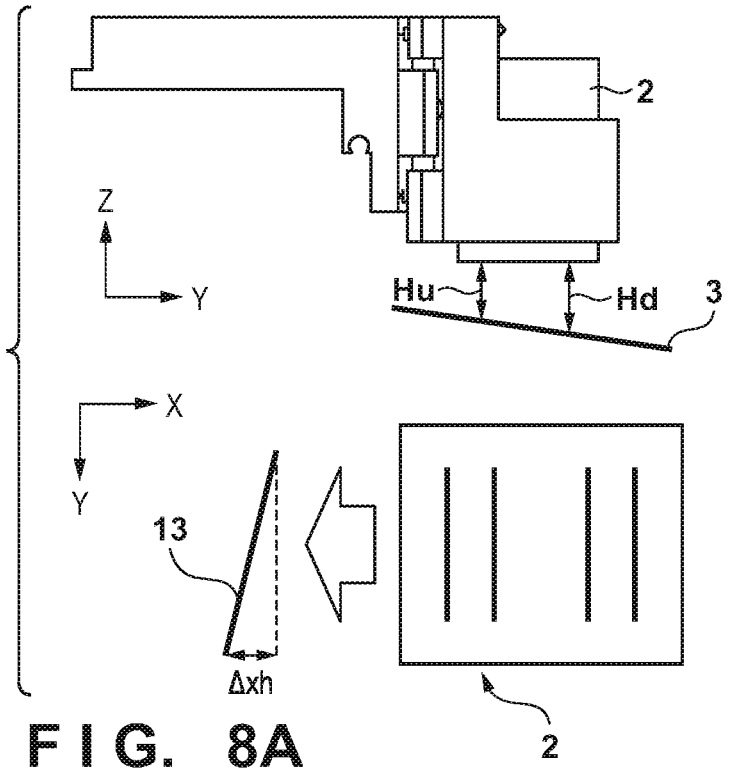
FIGS. 8A and 8B are views which illustrate a print shift Δxh caused by an upstream-downstream difference in the distance to the sheet.
Figure 8B:
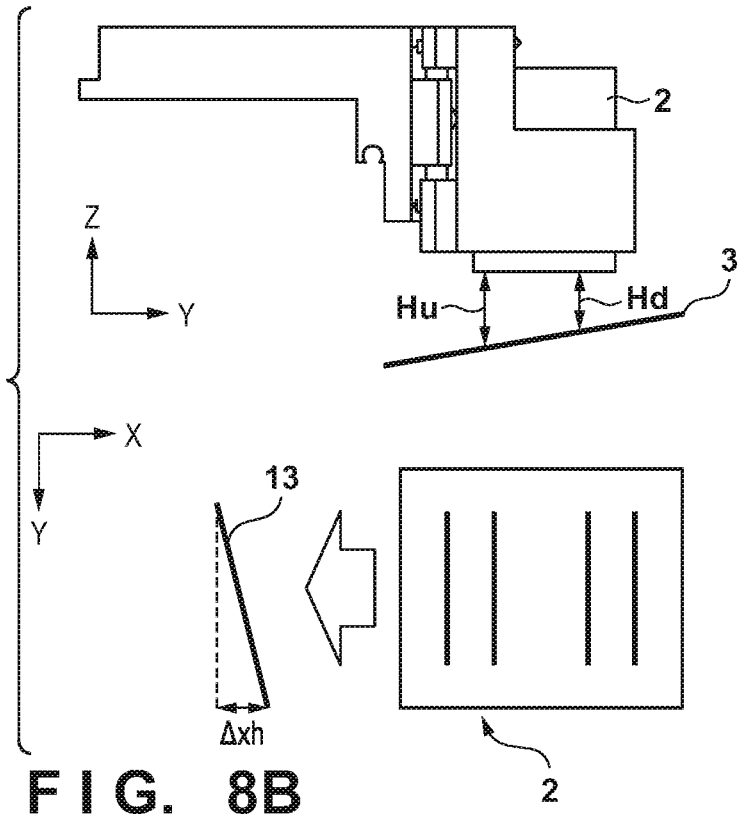

FIG. 8A and FIG. 8B are views that illustrate a print shift Δxh due to an upstream-downstream difference in the distance to the sheet.

For the upstream-downstream difference in the distance to the sheet, an error of several tens of μm occurs respectively due to part tolerance and assembly of the printhead 2, the guide rails 7 and 8 which support the carriage 5, the carriage 5, and the platen 9. Due to this error, for the position of dots formed on the print medium 3 by ink discharged from the most upstream nozzle and ink discharged from the most downstream nozzle in the sub-scanning direction for the printhead 2, a print shift of Δxh occurs as indicated by Equation (1). Specifically, $$\Delta xh=(Hu-Hd)/Vi\times Vc \quad (1).$$

In Equation (1), Hu is the upstream side distance to the sheet which is a distance between the most upstream nozzle in the sub-scanning direction and the print medium, Hd is the downstream side distance to the sheet which is a distance between the most downstream nozzle in the sub-scanning direction and the print medium, Vc is the scanning speed of the carriage 5, and Vi is the discharge speed of the ink. Here, when Hu=1 mm, Hd=1.3 mm, Vc=2000 mm/s, Vi=10000 mm/s, Δxh in the case of printing with the carriage 5 moving in the forward direction is as follows. Specifically, $$\begin{aligned}\Delta xh &= (1-1.3)/10000\times 2000\\ &= -0.06\ \text{mm}\\ &= -60\ \mu\text{m}.\end{aligned}$$

That is, as illustrated in FIG. 8A, the printing position by the most downstream nozzle is shifted to the left side (− direction on the X axis) by 60 μm with respect to the printing position by the most upstream nozzle. Conversely, when Hu=1.3 mm and Hd=1 mm, as illustrated in FIG. 8B, the printing position by the most downstream nozzle is shifted to the right side (+ direction on the X axis) by 60 μm with respect to the printing position in the most upstream nozzle.

Figure 9A:
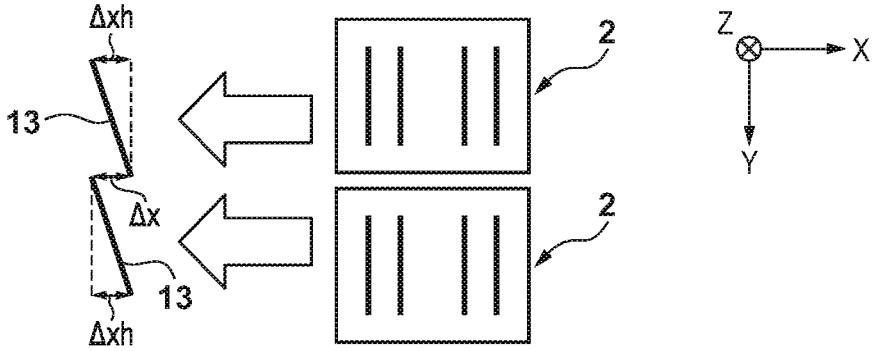
FIGS. 9A, 9B, and 9C are views which illustrate an influence on a ruled line shift Δx caused by an upstream-downstream difference in the distance to the sheet.
Figure 9B:
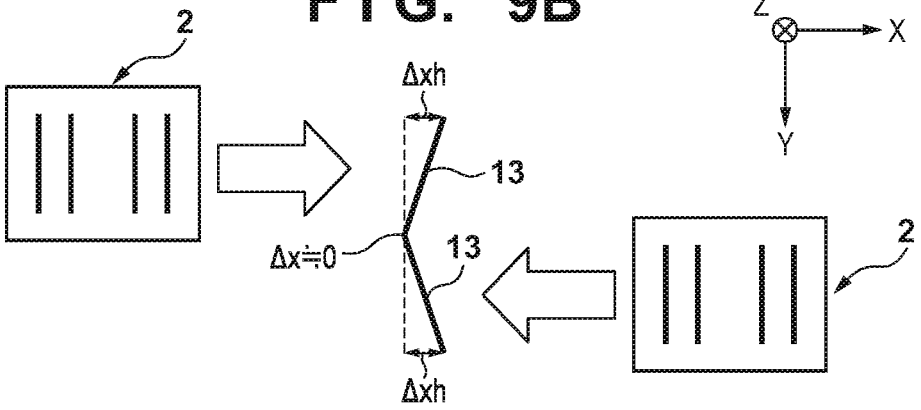
Figure 9C:
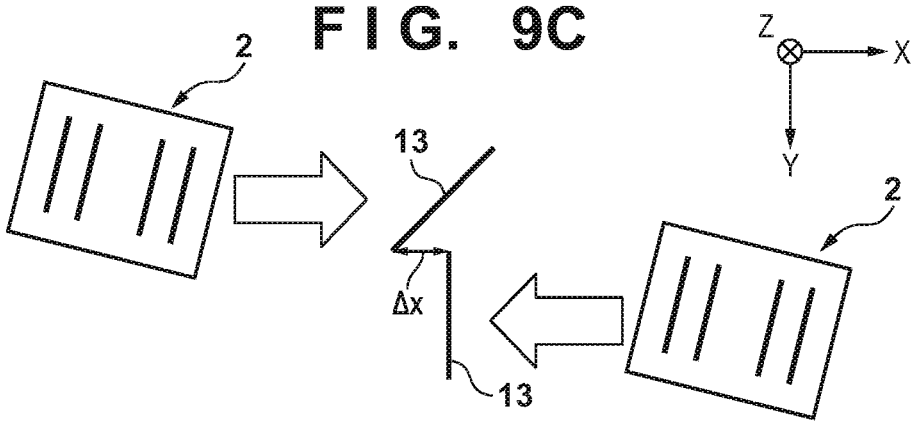

FIGS. 9A to 9C are views that illustrate the influence on the ruled line shift Δx of an upstream-downstream difference in the distance to the sheet.

In the case of one-way printing, a print shift Δxh due to the upstream-downstream difference in the distance to the sheet appears in the image as the ruled line shift Δx as illustrated in FIG. 9A. In contrast to this, since, in the case of two-way printing, the directions of the shifts are opposite in the case of printing during forward movement and printing during backward movement of the printhead 2, as illustrated in FIG. 9B, the print shift Δxh due to the upstream-downstream difference in the distance to the sheet occurs, but the ruled line shift Δx is approximately 0. In the case of performing high speed printing where ruled line image precision is required, it is typical to perform two-way printing, and therefore correction of the print shift Δxh due to the upstream-downstream difference in the distance to the sheet is not always necessary.

Accordingly, in the case of a printing apparatus for which, for example, there is no print shift Δxθ due to a slant and there is only the print shift Δxh due to the upstream-downstream difference in the distance to the sheet, the ruled line shift Δx is approximately "0" even when the slant is not adjusted, considering two-way printing. In other words, there is no need to perform slant adjustment.

However, as is described later, it is typical to perform slant adjustment with one-way printing when printing an adjustment pattern for correcting the print shift Δxθ due to the slant. This is because an overlapping error for the printing position in forward printing and backward printing in the case of two-way printing is reduced as much as possible thereby. Thus, as the adjustment pattern, the print shift Δxh due to the upstream-downstream difference in the distance to the sheet illustrated in FIG. 9A appears in the image as a ruled line shift Δx. In the case where this is adjusted by the adjustment lever 10, as illustrated in FIG. 9C, there is the possibility that the ruled line shift Δx will worsen in two-way printing. In other words, the ruled line shift Δx according to the adjustment pattern appears in the image as a shift that is the combination of Δxθ due to the slant for one-way printing and Δxh due to the upstream-downstream difference in the distance to the sheet.

Accordingly, in the case where the ruled line shift Δx according to two-way printing is reduced, if it is possible to extract only the print shift Δxθ due to the slant in a state where the upstream-downstream difference in the distance to the sheet Δxh is cancelled and perform adjustment by the adjustment lever 10, the previously described error will be reduced, and high-accuracy adjustment will be possible.

<Print Shift Adjustment (FIG. 10 to FIG. 13)>

Here, the adjustment value of the adjustment lever 10 for correcting the print shift Δxθ due to the slant is determined based on the result of printing an adjustment pattern at two different carriage speeds.

Figure 10:
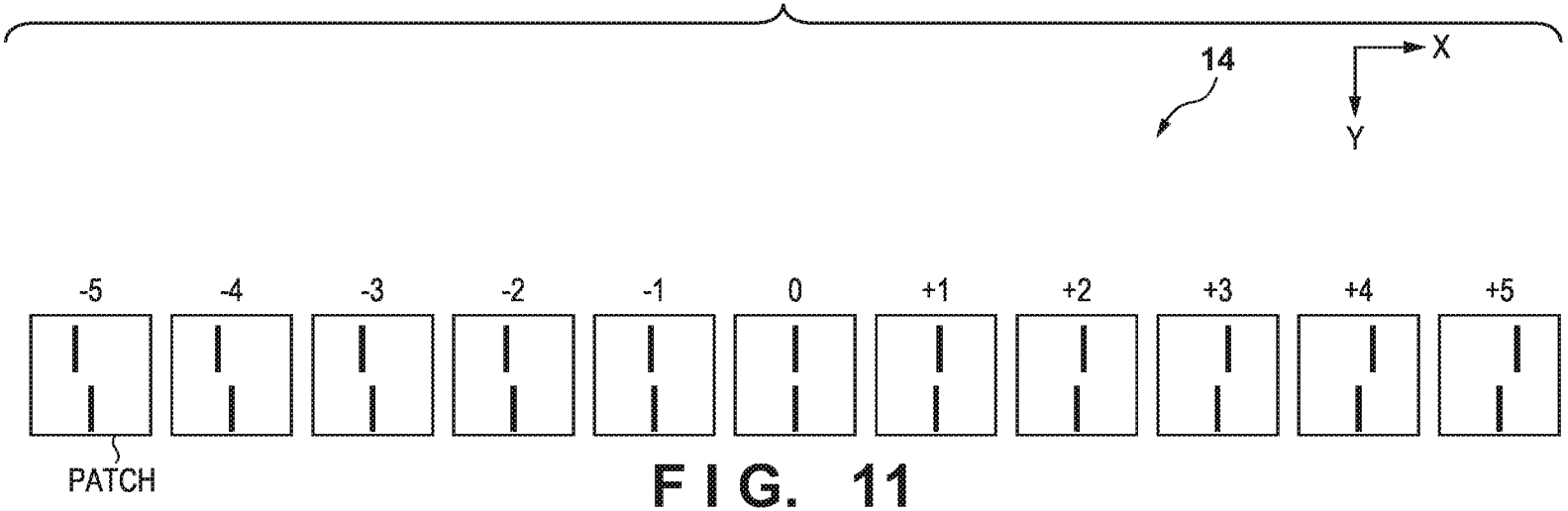
FIG. 10 is a view which illustrates a relationship between adjustment values of an adjustment lever and an adjustment pattern.
Figure 11:
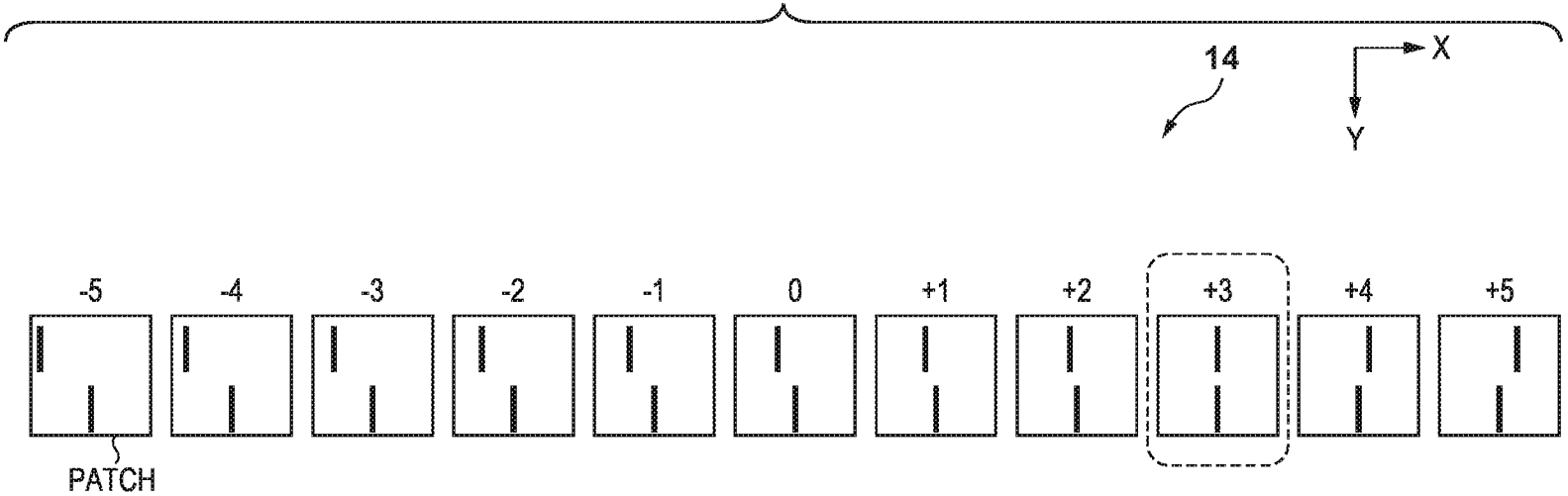
FIG. 11 is a view which illustrates a relationship between adjustment values of the adjustment lever and an adjustment pattern.

FIG. 10 and FIG. 11 are views illustrating a relationship between the adjustment pattern and the adjustment values of the adjustment lever.

As illustrated in FIG. 10 and FIG. 11, an adjustment pattern 14 is configured by combining 11 types of patches, and the numerical values, with the left side being the − direction, −5, −4, −3, −2, −1, ±0, +1, +2, +3, +4, and +5 are allocated. These numerical values correspond to the print position shifts from ±0. These patches are printed to be lined up in the main scanning direction (the X direction), and ruled lines printed in the sub-scanning direction (the Y direction) are included in each patch. Here, regarding the ruled lines included in the respective 11 patches that configure the adjustment pattern 14, the lower half ruled lines are printed using the nozzles on the upstream side half in the sub-scanning direction of the nozzle array of the printhead 2 in a first carriage movement. Also, the upper half ruled line is printed using the nozzles on the downstream side half in the sub-scanning direction of the nozzle array of the printhead 2 in a second carriage movement. The adjustment pattern 14 is printed only when performing a forward movement in order to prevent a print shift in two-way printing of the printhead 2.

Note that ruled lines are divided in two equal parts as the upper half and the lower half, and are printed using the upstream side half nozzles and downstream side half nozzles in the sub-scanning direction that correspond to these, but the ruled line division and divided printing thereof are not limited to the foregoing description. For example, configuration may be taken to divide unequally, print a portion of the ruled line with upstream side portion nozzles corresponding thereto, and print the rest of the ruled line with the remaining nozzles on the downstream side corresponding thereto.

As illustrated in FIG. 10 and FIG. 11, whereas the lower half ruled lines are printed evenly spaced, the upper half ruled lines are printed with a shift to the right side in the main scanning direction (the X direction) every 20 μm as they proceed to the right. That is, the upper half ruled lines are printed at positions shifted −100 μm at −5 and +100 μm at +5 where the left side is—and the right side is + from the ±0 position. Also, in the case where there is no print shift, as illustrated in FIG. 10, the ruled line on the upper half and the ruled line and the lower half coincide at the ±0 position. In this way, since printing is performed with stepwise shifting of the printing positions (print timing), the print shift Δx is expressed by where the ruled lines on the top side half and the bottom side half coincide when actually printing on the print medium. For example, when printing the adjustment pattern 14, in the case where the position at which the ruled lines coincide is 0 as illustrated in FIG. 10, the ruled line shift amount Δx=0 μm, and in the case where the position at which the ruled lines coincide is +3 as illustrated in FIG. 11, the ruled line shift amount Δx=60 μm.

Figure 12:
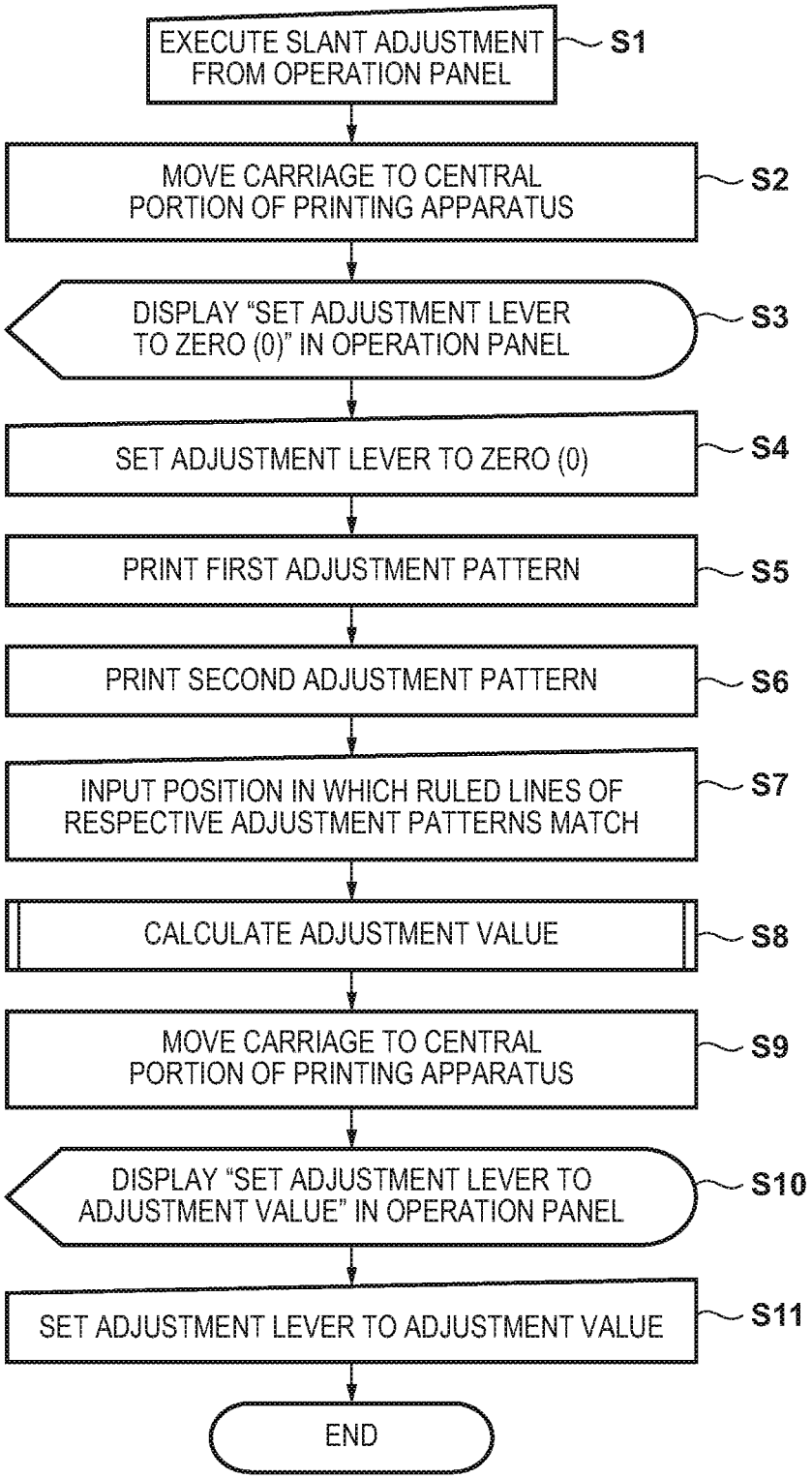
FIG. 12 is a flowchart which illustrates details of print shift adjustment processing.

FIG. 12 is a flowchart which illustrates details of print shift adjustment processing.

Firstly, in step S1, when the user instructs slant adjustment execution from the operation panel 15 of the printing apparatus 1, the carriage 5, in step S2, moves to the center portion of the printing apparatus 1. Then, in step S3, the user is prompted on the operation panel 15 to align the adjustment lever 10 to "0" with respect to the carriage 5 that has moved, and in step S4, the user aligns the adjustment lever 10 with "0".

After that, in step S5, the printing apparatus 1 prints a first adjustment pattern 16 at a first carriage speed (Vc1), and then in step S6, prints a second adjustment pattern 17 at a second carriage speed (Vc2).

Next, in step S7, the user visually confirms the point at which the ruled lines of the respective adjustment patterns coincide, and inputs the result into the printing apparatus 1 using the operation panel 15. This point is represented by print shift amounts Δx1 and Δx2 for the carriage speeds Vc1 and Vc2, respectively. The print shift amounts Δx1 and Δx2 of the respective carriage speeds can be expressed by Equation (2) and Equation (3). Specifically, $$\Delta x1=\Delta x\theta+(Hu-Hd)/Vi\times Vc1 \quad (2)$$

$$\Delta x2=\Delta x\theta+(Hu-Hd)/Vi\times Vc2 \quad (3).$$

Here, Δxθ is the print shift due to the slant, Hu is the upstream side distance to the sheet which is the distance between the most upstream nozzle and the print medium, Hd is the downstream side distance to the sheet which is the distance between the most downstream nozzle and the print medium, and Vi is the discharge speed of the ink. Since the print shift amounts Δx1 and Δx2 are known from the results of printing the adjustment pattern, it is possible to express the adjustment value of the adjustment lever 10, in other words, the print shift Δxθ due to slant by Equation (4). Specifically, $$\Delta x\theta=(\Delta x2\times Vc1-\Delta x1\times Vc2)/(Vc1-Vc2) \quad (4).$$

In this way, it is possible to obtain a print shift Δxθ that cancels the influence of the upstream-downstream difference in the distance to the sheet.

Accordingly, in step S8, the print shift amount Δxθ due to the slant is calculated in the main body of the printing apparatus 1 by Equation (4).

Next, in step S9, the printing apparatus 1 is caused to once again move to the center portion of the carriage 5. Furthermore, in step S10, the adjustment value of the adjustment lever 10 for reducing the print shift amount Δxθ is notified to the user by displaying it on the operation panel 15. In step S11, the user adjusts the adjustment lever 10 based on the notified adjustment value accordingly.

The slant is adjusted by such a sequence of processing.

Here, description is given using specific numerical values for the calculation of the adjustment value.

Figure 13:
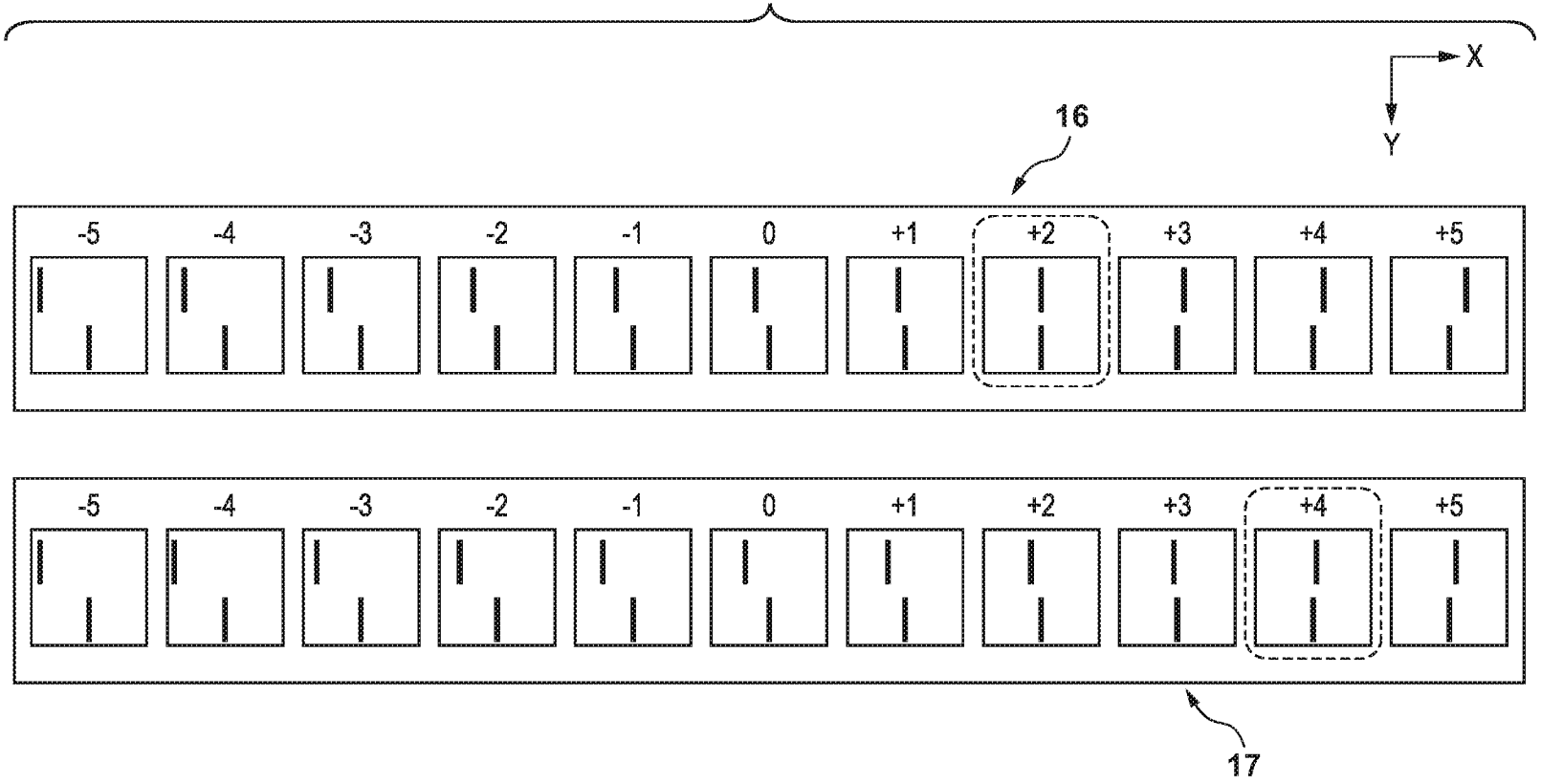
FIG. 13 is a view which illustrates a state in which a first adjustment pattern and a second adjustment pattern are printed at a first carriage speed and a second carriage speed.

FIG. 13 is a view which illustrates a state in which the first adjustment pattern 16 and the second adjustment pattern 17 are printed with the first carriage speed (Vc1) and the second carriage speed (Vc2).

Here, Vc1=300 mm/s and Vc2=2600 mm/s. In a case, as illustrated in FIG. 13, where the position at which the ruled lines of the first adjustment pattern 16 printed with the first carriage speed (Vc1) coincide is +2, and the position at which the ruled lines of the second adjustment pattern 17 printed with the second carriage speed (Vc2) coincide is +4, the print shift Δxθ is as follows. Specifically, $$\begin{aligned}\Delta x\theta &= (0.08\times 300 - 0.04\times 2600)/(300-2600)\\ &\approx 0.035\ (\text{mm})\\ &= 35\ (\mu\text{m}).\end{aligned}$$

Since the adjustment lever 10 only moves in 20 μm increments, the adjustment value at which it is possible to make the print shift Δxθ due to the slant of the printhead 2 a minimum is +2. This adjustment value is notified to the user by the operation panel 15, and by the user moving the adjustment lever 10 to "+2", the print shift Δxθ due to the slant of the printhead 2 is $$\begin{aligned}\Delta x\theta &= 35 - 40\\ &= -5\ (\mu\text{m})\end{aligned}$$

which approaches 0. That is, it is possible to make the print shift smaller.

Accordingly, by virtue of the embodiment described above, it is possible to adjust the print shift Δxθ due to the slant in a state in which the print shift Δxh due to the upstream-downstream difference in the distance to the sheet is cancelled from the result of printing the adjustment pattern for adjusting the slant of the printhead at two different carriage speeds. Consequently, it is possible to perform adjustment that reduces error, a ruled line shift is reduced, and printing quality improves.

Note that in the embodiment described above, description was given using the example of printing an adjustment pattern where the scanning direction of the carriage 5 is made to be the long side direction, but the present invention is not limited by this. For example, since it is possible to consider that the upstream-downstream difference in the distance to the sheet will change in the long side direction of the adjustment pattern depending on the precision of the platen 9 and the guide rails 7 and 8, an adjustment pattern may be printed with the conveyance direction of the print medium as the long side direction.

Figure 14:
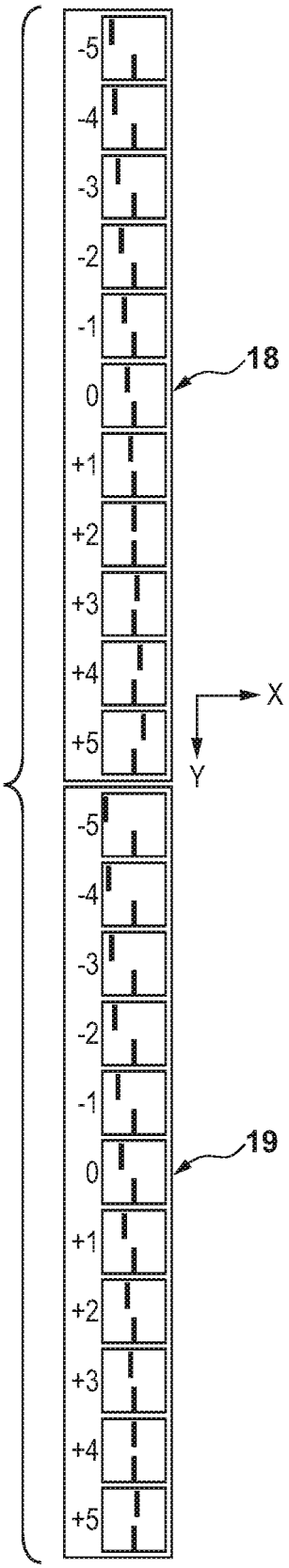
FIG. 14 is a view which illustrates a state in which two adjustment patterns are printed in a conveyance direction of a print medium.

FIG. 14 is a view which illustrates a state in which two adjustment patterns are printed in a conveyance direction of a print medium.

As illustrated in FIG. 14, a third adjustment pattern 18 and a fourth adjustment pattern 19 with the conveyance direction of the print medium 3 as the long side direction are printed such that 11 patches on which ruled lines are respectively printed in the sub-scanning direction are lined up in the sub-scanning direction. By this, each adjustment pattern ends up being printed in an environment in which there is a certain upstream-downstream difference in the distance to the sheet. By virtue of this example, it is possible to adjust the print shift Δxθ due to the slant in a state in which the print shift Δxh due to the upstream-downstream difference in the distance to the sheet is cancelled independent of the manufacturing precision of the rail axes (longitudinal direction) direction of the guide rails 7 and 8 and the platen 9.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-014117, filed Jan. 30, 2018, which is hereby incorporated by reference herein in its entirety.

What is claimed is:

1. A printing apparatus comprising:

a printhead that has a nozzle array in which a plurality of nozzles configured to discharge ink are arrayed;

a conveyance unit configured to convey a print medium in a first direction;

a carriage on which the printhead is mounted such that a direction of the nozzle array is approximately the first direction and configured to reciprocally move in a second direction that intersects the first direction;

a print unit configured to print a first pattern on a print medium when the carriage is moving at a first speed, and to print a second pattern on the print medium when the carriage is moving at a second speed different from the first speed in a movement direction that is the same as the movement direction at the first speed;

an obtaining unit configured to obtain an adjustment value that is for adjusting a print shift in relation to the second direction and that is related to the first pattern and the second pattern printed by the print unit;

an adjustment unit configured to adjust a slant of the printhead with respect to the first direction; and an instruction unit configured to instruct the adjustment value obtained by the obtaining unit to the adjustment unit.

2. The apparatus according to claim 1, wherein the adjustment unit adjusts the slant of the printhead by rotating the printhead about a third direction orthogonal to the first direction and the second direction, and the instruction unit is a lever that is arranged at a side surface of the adjustment unit and is rotatable in accordance with the adjustment value.

3. The apparatus according to claim 2, wherein the first pattern and the second pattern each includes a plurality of patches printed to be lined up in the second direction, the plurality of patches each includes a ruled line printed in a direction of the nozzle array, and the print unit prints a portion of the ruled line using a nozzle on an upstream side of the printhead with respect to the first direction among the plurality of nozzles and prints the rest of the ruled line using a nozzle on a downstream side of the printhead with respect to the first direction among the plurality of nozzles.

4. The apparatus according to claim 3, wherein the print unit, when printing the plurality of patches to be lined up in the second direction, performs printing without changing a printing position by the nozzle on the downstream side, and performs printing while changing a printing position by the nozzle on the upstream side for the plurality of patches.

5. The apparatus according to claim 4, wherein the obtaining unit, for each of the first pattern and the second pattern printed on the print medium, obtains the adjustment value based on a printing position for a case in which the portion of the ruled line printed using the nozzle on the upstream side and the rest of the ruled line printed using the nozzle on the downstream side coincide.

6. The apparatus according to claim 2, wherein the first pattern and the second pattern each includes a plurality of patches printed to be lined up in the first direction, the plurality of patches each includes a ruled line printed in a direction of the nozzle array, and the print unit prints a portion of the ruled line using a nozzle on an upstream side of the printhead with respect to the first direction among the plurality of nozzles and prints the rest of the ruled line using a nozzle on a downstream side of the printhead with respect to the first direction among the plurality of nozzles.

7. The apparatus according to claim 6, wherein the print unit, when printing the plurality of patches to be lined up in the first direction, performs printing without changing a printing position by the nozzle on the downstream side, and performs printing while changing a printing position by the nozzle on the upstream side for the plurality of patches.

8. The apparatus according to claim 7, wherein the obtaining unit, for each of the first pattern and the second pattern printed on the print medium, obtains the adjustment value based on a printing position for a case in which the portion of the ruled line printed using the nozzle on the upstream side and the rest of the ruled line printed using the nozzle on the downstream side coincide.

9. The apparatus according to claim 8, wherein the obtaining unit obtains the adjustment value based on an input from a user regarding coincidence between the portion of the ruled line and the rest of the ruled line.

10. The apparatus according to claim 8, wherein the adjustment value is calculated in accordance with the equation:

$$\Delta x\theta=(\Delta x2\times Vc1-\Delta x1\times Vc2)/(Vc1-Vc2),$$

where $\Delta x\theta$ is the adjustment value, $Vc1$ is the first speed, $Vc2$ is the second speed, $\Delta x1$ is a shift amount of a printing position corresponding to a case in which the portion of the ruled line and the rest of the ruled line in the first pattern coincide, and $\Delta x2$ is a shift amount of a printing position corresponding to a case in which the portion of the ruled line and the rest of the ruled line in the second pattern coincide.

11. The apparatus according to claim 10, further comprising:

an input unit configured to input information of a printing position corresponding to ruled line for which coincidence was confirmed by the user; and a display unit configured to display the adjustment value calculated by the calculation unit and prompt an instruction by the user.

12. The apparatus according to claim 1, wherein the printhead, in order to discharge a plurality of inks, comprises a plurality of nozzle arrays arranged in a direction different from a direction in which the plurality of nozzles are arranged.

* * * * *